US009671756B2

(12) United States Patent
Stranczl et al.

(10) Patent No.: US 9,671,756 B2
(45) Date of Patent: Jun. 6, 2017

(54) FASTENING OF A TIMEPIECE SPRING BY ADHESIVE BONDING

(71) Applicant: Nivarox-FAR S.A., Le Locle (CH)

(72) Inventors: Marc Stranczl, Nyon (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/162,726

(22) Filed: May 24, 2016

(65) Prior Publication Data

US 2017/0017204 A1 Jan. 19, 2017

(30) Foreign Application Priority Data

Jul. 16, 2015 (EP) ..... 15176978

(51) Int. Cl.
*G04B 17/32* (2006.01)
*G04B 17/34* (2006.01)

(52) U.S. Cl.
CPC ..... *G04B 17/34* (2013.01); *G04B 17/325* (2013.01)

(58) Field of Classification Search
CPC ..... G04B 17/32; G04B 17/325; G04B 17/34
USPC ..... 368/178
See application file for complete search history.

(56) References Cited

U.S. PATENT DOCUMENTS 4,055,944 A * 11/1977 Widmer ..... G04B 17/325 368/178
5,294,097 A * 3/1994 Thomsen ..... F16F 1/10 185/45
2015/0177689 A1* 6/2015 Capt ..... G04B 17/325 368/178

FOREIGN PATENT DOCUMENTS

| | | |
|---|---|---|
| CH | 703 172 A2 | 11/2011 |
| DE | 23 33 446 A1 | 1/1975 |
| EP | 1 515 200 A1 | 3/2005 |
| FR | 2 051 170 | 4/1971 |

OTHER PUBLICATIONS

European Search Report issued Mar. 2, 2016 in European Application 15176978, filed on Jul. 16, 2015 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

Timepiece sub-assembly including a balance spring stud arranged to be fastened to a balance cock, and a balance spring comprising an outer coil and an end plate of larger section than that of the outer coil, this stud including a housing arranged, in a first free state of the sub-assembly, to loosely contain the end plate with tangential mobility with respect to the outer coil, and, in a second immobilized state of the sub-assembly, to immobilize the end plate to which the housing is joined by a layer of adhesive covering a change-of-section shoulder and which forms a mechanical seal for the balance spring in a longitudinal direction of the housing, and the end plate includes an eye communicating with the layer in the second immobilized state.

16 Claims, 2 Drawing Sheets

FASTENING OF A TIMEPIECE SPRING BY ADHESIVE BONDING

This application claims priority from European Patent Application No. 15176978.3 filed on Jul. 16, 2015, the entire disclosure of which is hereby incorporated herein by reference.

FIELD OF THE INVENTION

The invention concerns a timepiece sub-assembly, comprising a balance spring stud arranged to be fastened to a balance cock of a timepiece movement, said sub-assembly comprising a balance spring, including in series and in order: a spiral wound part, an outer coil, a connection area, and an end plate of larger section than that of said outer coil, said end plate ending in a distal end opposite to said spiral wound part, said balance spring stud comprising, between an entry and an exit, a housing which is arranged, in a first free state of said sub-assembly, to loosely contain said end plate of said balance spring with tangential mobility in a tangential direction with respect to said outer coil in said connection area, and, in a second immobilised state of said sub-assembly, to immobilise said end plate to which said housing is joined by a layer of adhesive which secures them to each other, and, in said second immobilised state, said adhesive layer covers at least a change-of-section shoulder portion of said end plate, and wherein, in said second immobilised state, said adhesive layer forms a mechanical seal for said balance spring at least in a longitudinal direction of said housing substantially parallel to said tangential direction of said balance spring.

The invention also concerns an oscillator including at least one such sub-assembly.

The invention also concerns an escapement mechanism including at least one such sub-assembly.

The invention also concerns a watch including such an escapement mechanism and/or including at least one such sub-assembly.

The invention concerns the field of mechanical oscillators for timepieces comprising at least one elastic return means formed by a balance spring, and more specifically the case where such a balance spring is made of silicon or silicon oxide, or DLC, or other similar micromechanical material made in accordance with a MEMS or similar method.

BACKGROUND OF THE INVENTION

The invention more particularly concerns the fastening of the outer part of the spring, which, in conventional timepiece oscillators, notably with a sprung balance, is generally fastened to a balance spring stud, fastened in turn to a balance cock.

The outer part of the balance spring is generally adhesive bonded in the stud. The bonding position is generally difficult to reproduce, due to shrinkage of the adhesive which is also difficult to reproduce. The quality of the bond is difficult to test once it is made, other than by destructive testing performed on a sample. However, due to the poor reproducibility of the bond, even with a fixed operation, i.e. having tightly controlled parameters, there is no assurance that the sample is representative of the entire batch. The risk is that the balance spring will become detached from the stud once the adhesive has set.

The use of a balance spring comprising an end plate provides a relative improvement in bonding, in that the use of a plate of larger dimensions than the coils of the spring provides a larger bonding contact surface. Indeed, the strength of the adhesive bond is poor when the section and dimensions of the component to be bonded, in this case the balance spring, decrease too much. The plate is required to ensure that a certain amount of contact surface is provided for the adhesive layer, to ensure mechanical strength, which is indispensable since chemical strength alone is not sufficient to securely hold the components to be assembled.

Patent Application DE 2333446 A1 in the name of JUNGHANS GmbH discloses a balance spring, wherein the outer end of the balance spring is placed on a projecting portion of a plate made of plastic material, and held in position by melting the plastic material. The end of the spring can be placed in a slot provided in the projecting portion, whose shoulders may be melted by ultrasonic welding. The fastening is improved by cutting a notch in an edge of the end of the spring in the fastening area. The weld is reversible, and can be removed during repair and conventional adhesive bonding methods remain possible.

SUMMARY OF THE INVENTION

The invention proposes to ensure the improved operating performance of the connection between the stud and the balance spring plate which are assembled by adhesive bonding.

To achieve this, it must be ensured that there is sufficient space between the end plate and its housing in the stud, so as to ensure proper flow of the adhesive into the housing and, consequently, to obtain improved strength of the bonded assembly.

The invention prefers the use of a "shaped" plate, i.e. having a specific shape, optimised to ensure better mechanical strength of the bonded assembly, notably resisting traction. Thus, if it is necessary to reduce the dimensions of the end plate, the insertion of an end plate of suitable shape ensures good strength, even if the adhesive contact surface is greatly reduced.

To this end, the invention concerns a timepiece sub-assembly according to claim 1.

The invention also concerns an oscillator including at least one such sub-assembly.

The invention also concerns an escapement mechanism including at least one such sub-assembly.

The invention also concerns a watch including such an escapement mechanism and/or including at least one such sub-assembly.

BRIEF DESCRIPTION OF THE DRAWINGS

Other features and advantages of the invention will appear upon reading the following detailed description, with reference to the annexed drawings, in which.

Figure 1:
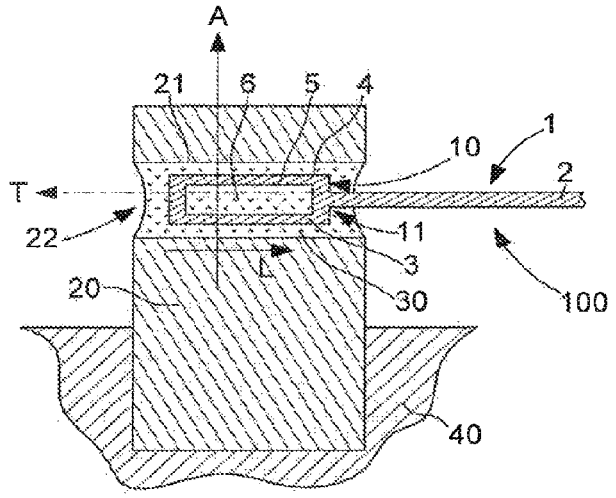
FIG. 1 shows a schematic view of a section of a timepiece sub-assembly according to the invention, comprising a balance spring stud fastened to a balance cock, the stud receiving, in a housing comprised therein, an end plate of a balance spring, the section being represented in a substantially median plane to the plate on the one hand, and to the last outer coil of the balance spring adjacent to the plate, on the other hand. The plate includes an eye. An adhesive layer fills the housing in the stud, totally fills the eye, and the end menisci formed by the adhesive layer extend, on the inner side of the balance spring, beyond a shoulder formed on an area of connection between the end plate and the last outer coil of the spring, and on the outermost side of the balance spring, beyond the distal end of the balance spring, in a tangential direction with respect to said outer coil on the connection area, so that the end plate is entirely surrounded by the adhesive layer in all directions. The portion of the adhesive layer inside the eye forms a stop pin which is highly resistant to being pulled out.
Figure 2:
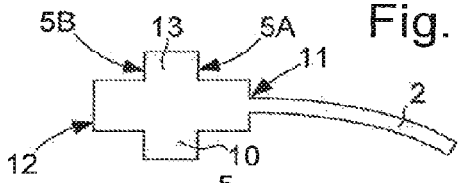
FIGS. 2 to 7 show, each in a similar section to that of FIG. 1, balance spring ends including plates of different geometries, all studied to provide optimum mechanical resistance to removal by pulling, in particular in the tangential direction.
Figure 5:
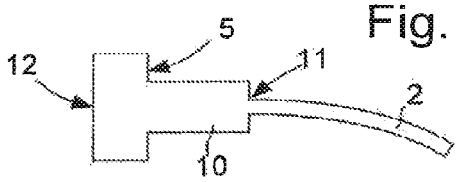
Figure 3:
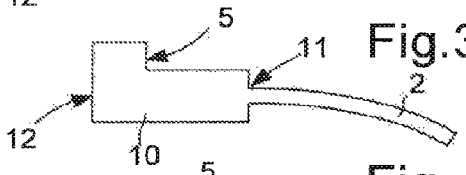
Figure 6:
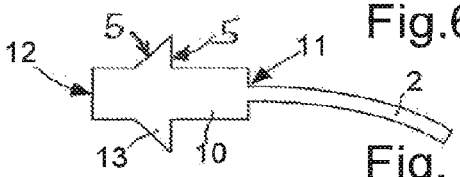
Figure 4:
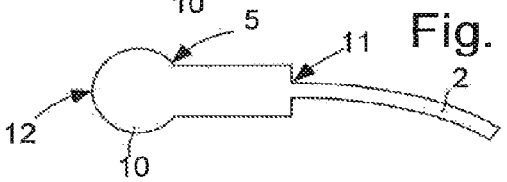
Figure 7:
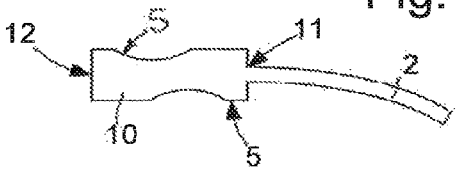
Figure 8:
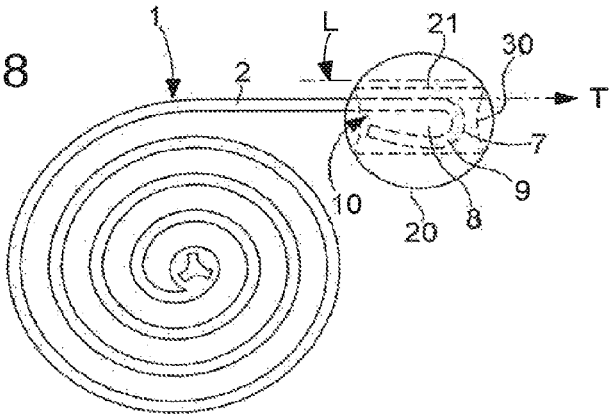
Figure 9:
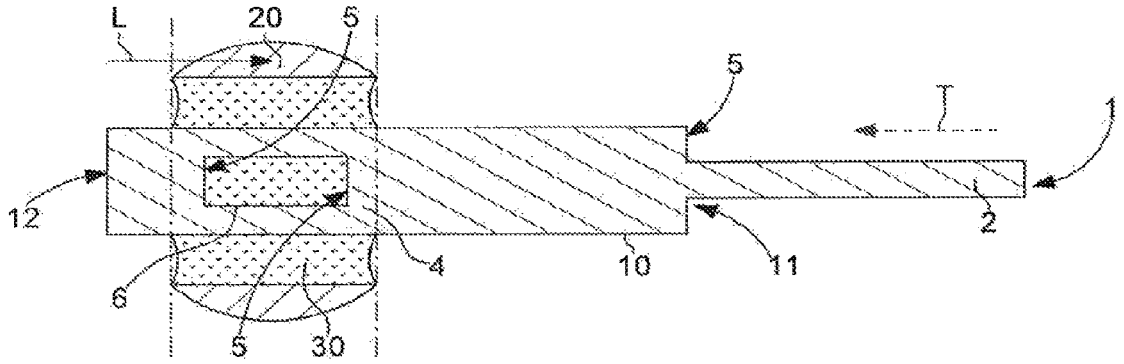
Figure 10:
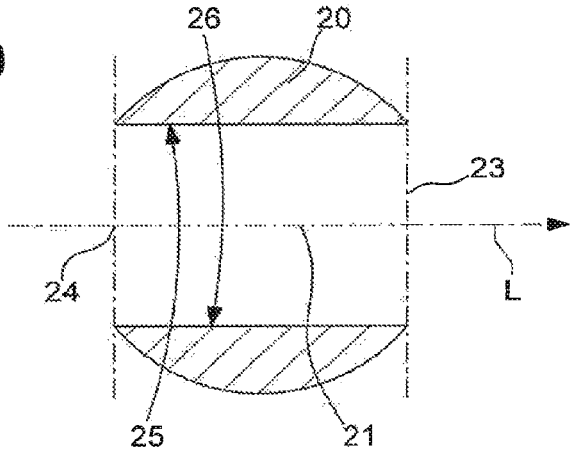
Figure 11:
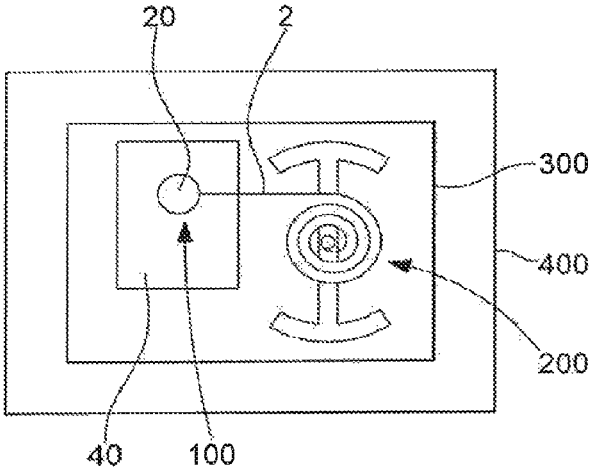

the end plate of FIG. 2 includes two shoulders which face each other, and together delimit a stop of maximum section of the end plate, this stop forming the transverse arm of a cross whose longitudinal arm is in the extension of the outer coil of the balance spring;

the end plate of FIG. 3, which is L-shaped, includes a shoulder which faces its distal end, and delimits therewith a transverse arm projecting transversely on a single side with respect to a longitudinal arm of the plate, which is in the extension of the outer coil of the balance spring, the end plate of FIG. 4 includes a substantially cylindrical portion at its distal end, projecting transversely on both sides relative to a longitudinal arm of the plate, which is in the extension of the outer coil of the balance spring;

the end plate of FIG. 5, which is T-shaped, includes a shoulder which faces its distal and, and delimits therewith a transverse arm projecting transversely on both sides relative to a longitudinal arm of the plate, which is in the extension of the outer coil of the balance spring, the end plate of FIG. 6 is a variant of FIG. 2, wherein the transverse stop arm is straight on the side of the outer coil of the balance spring, and slopes on the opposite side, forming a chamfer;

the end plate of FIG. 7 includes, on both sides of a longitudinal arm which is in the extension of the outer coil of the balance spring, two recessed profiles, not directly opposite here in this particular, but non-limiting embodiment, each arranged to receive the adhesive layer in a similar manner to the eye of FIG. 1;

FIG. 8 shows a section of a balance spring wherein the outer coil ends in a loop forming an eye to stop the adhesive layer, this loop being then housed inside the stud housing;

FIG. 9 is a variant of FIG. 1, of more reduced dimensions, wherein the balance spring includes, between the outer coil and the end plate, an outer shoulder which is not surrounded by the adhesive layer, and wherein the distal end of the end plate is also not surrounded by the adhesive layer, which passes straight through an eye in the end plate to immobilise the latter. This outer shoulder is useful for adjusting an optical or mechanical guide mark, or for displaying or marking the useful length of the balance spring when said length is determined by contact between an area of the outer coil and a pin or suchlike, the outer shoulder then allowing for better understanding of the position of the contact zone and calculation, if necessary, of the exact useful length;

FIG. 10 is a section of the empty stud housing;

FIG. 11 is a block diagram illustrating a watch including a movement which incorporates a sprung balance oscillator including a sub-assembly according to the invention.

DETAILED DESCRIPTION OF PREFERRED EMBODIMENTS

The invention ensures the improved operating performance of the connection between the balance spring stud and the balance spring plate which are assembled by adhesive bonding, based on good mechanical strength, which makes up for chemical strength which, alone, is insufficient to securely hold together the components to be assembled, particularly as regards resistance to removal by pulling in the tangential direction to the outer coil of the balance spring, where the return torque is applied. Once the adhesive layer has set in the stud housing, the particular geometry of the plate must ensure this mechanical strength, and prevents removal of the plate from the block of set adhesive.

To this end, the invention concerns a timepiece sub-assembly 100, including a balance spring stud 20 arranged to be fastened to a balance cock 40 of a timepiece movement 300. This sub-assembly 100 includes a balance spring 1.

This balance spring 1 includes in series and in order: a spiral wound part, an outer coil 2, a connection area 11, and an end plate 10 of larger section than that of outer coil 2, end plate 10 ending in a distal end 12 opposite to the spiral wound part, and connection area 11 including a change of section between outer coil 2 and end plate 10.

Balance spring stud 2 comprises, between an entry 23 and an exit 24, a housing 21 which is arranged, in a first free state of sub-assembly 100, to loosely contain end plate 10 of balance spring 1 with tangential mobility in a tangential direction T with respect to outer coil 2 in connection area 11, and, in a second immobilised state of sub-assembly 100, to immobilise end plate 10 to which housing 21 is joined by a layer of adhesive 30 which secures them to each other.

According to the invention, in the second immobilised state, adhesive layer 30 covers at least a change-of-section shoulder 5 of end plate 10.

In the particular but non-limiting case of FIG. 1, adhesive layer 30 also covers connection area 11. This arrangement only concerns applications where the point of definition of the active length of the balance spring is located in a different area of outer coil 2 from connection area 11.

For many ordinary applications where connection area 11 defines the active length of the balance spring, the variant of FIG. 9 is preferred. Indeed, if the adhesive is deposited on connection area 11, the useful length of the balance spring is modified, and consequently the frequency and rate of the balance spring are modified, which is not desired, there should not therefore be any adhesive on connection area 11.

In this second immobilised state, adhesive layer 30 forms a mechanical seal for balance spring 1 at least in a longitudinal direction L of housing 21 substantially parallel to tangential direction T of balance spring 1.

More specifically, as seen in the variant of FIG. 1, in the second immobilised state, adhesive layer 30 covers connection area 11 and forms a mechanical seal for balance spring 1, at least in a longitudinal direction L of housing 21 substantially parallel to tangential direction T of balance spring 1.

FIG. 1 shows a stud positioned horizontally in the movement; of course the stud may be positioned in a conventional vertical position, the benefit provided by the invention is the same.

Preferably, housing 21 is sufficiently large for adhesive layer 32 to entirely surround at least one portion of end plate 10, this portion comprising one or more shoulders 5, 11 in the unique case of FIG. 1, but not in the more general case of FIG. 9, or at least one eye 6, with, in the free, non-bonded state, sufficient play between housing 21 and this particular portion of end plate 10 to ensure that, once deposited, adhesive layer 30 surrounds this portion of the end plate on all sides, so that adhesive layer 30 then forms a mechanical seal for balance spring 1 in housing 21 in all degrees of freedom.

Advantageously, housing 21 includes at least one protruding or recessed volume arranged to form at least one stop for adhesive layer 30, or includes, on its inner walls 25, 26 flutes or notches, or is made with a rough surface state, with a roughness R of more than 12 micrometers, so as to ensure mechanical retention of adhesive layer 30.

In the variants of FIGS. 2 to 7, end plate 10 includes variable sections perpendicularly to longitudinal direction L.

In the variants of FIGS. 1 and 9, where end plate 10 includes an eye 6, and where the external contour of end plate 10 is of substantially constant section, it is the cavity of eye 6 that determines a smaller resulting section than that of plate 10 outside the area of eye 6.

In a particular variant, and as seen particularly in FIGS. 3 and 5, the section of end plate 10 decreases, continuously and/or in steps, from its outer distal end 12 towards outer coil 2.

More specifically, as seen in FIG. 9, end plate 10 includes at least one shoulder 5 where the section of end plate 10 varies, said shoulder 5 being distinct from connection area 11 between outer coil 2 and end plate 10, and, in the second immobilised state, adhesive layer 30 covers this shoulder 5, whereas connection area 11 remains outside adhesive layer 30.

In the variants of FIGS. 2 and 6, end plate 10 includes at least a first shoulder 5A and a second shoulder 5B where the section of end plate 10 varies, first shoulder 5A and second shoulder 5B together delimiting a stop 13 of maximum section of end plate 10, first shoulder 5A and second shoulder 5B being distinct from connection area 11.

More specifically, in the same variants of FIGS. 2 and 6, first shoulder 5A and second shoulder 5B are distinct from distal end 12 of connecting plate 10.

In a particular variant, and as seen notably in FIGS. 1, 8 and 9, end plate 10 includes at least one eye 6, 8 communicating with adhesive layer 30 in the second immobilised state.

More specifically, when plate 10 includes such a stop 13, this eye 6, 8 is housed within the thickness of this stop 13 of maximum section of end plate 10.

In the particular variant of FIGS. 1 and 9, end plate 10 forms a loop 4 comprising at least one eye 6 in which layer 30, in the second immobilised state, only penetrates in an anchoring direction A substantially perpendicular to tangential direction T.

In the particular variant of FIG. 8, end plate 10 forms a hook 7 comprising at least one eye 8 open on the side of outer coil 2, and including a bent portion 9 at the end thereof farthest from outer coil 2.

FIGS. 2 to 7 illustrate different geometries of end plate 10 that are well suited to implementation of the invention: either with profiles that are protruding in FIGS. 2 to 6, cross-shaped, L-shaped, having a cylindrical end, T-shaped, with shoulders 5 forming perpendicular surfaces to the tangential direction and arranged to offer maximum resistance to traction in this direction towards the spiral portion of balance spring 1, or with recessed profiles as seen in FIG. 7, which are not necessarily directly opposite, to avoid weakening end plate 10 too much with an excessively small section.

The invention is particularly well suited to the fastening of a balance spring 1 made of silicon and/or silicon oxide, or DLC, or other similar micromechanical material made via a MEMS or similar method.

The invention also concerns an oscillator 200 including at least one such sub-assembly 100.

The invention also concerns an escapement mechanism 300 including at least one such sub-assembly 100.

The invention also concerns a watch 400 including such an escapement mechanism 200 and/or including at least one such sub-assembly 100.

What is claimed is:

1. A timepiece sub-assembly, comprising a balance spring stud arranged to be fastened to a balance cock of a timepiece movement, and said sub-assembly comprising a balance spring, including in series and in order: a spiral wound part, an outer coil, a connection area, and an end plate of larger section than that of said outer coil, said end plate ending in a distal end opposite to said spiral wound part, said balance spring stud comprising, between an entry and an exit, a housing which is arranged, in a first free state of said sub-assembly, to loosely contain said end plate of said balance spring with tangential mobility in a tangential direction with respect to said outer coil in said connection area, and, in a second immobilised state of said sub-assembly, to immobilise said end plate to which said housing is joined by a layer of adhesive which secures said end plate and housing to each other, wherein, in said second immobilised state, said adhesive layer covers at least one change-of-section shoulder of said end plate, and wherein, in said second immobilised state, said adhesive layer forms a mechanical seal for said balance spring at least in a longitudinal direction of said housing substantially parallel to said tangential direction of said balance spring, wherein said end plate includes at least one eye communicating with said layer in said second immobilised state.

2. The timepiece sub-assembly, according to claim 1, wherein said adhesive layer covers at least one change-of-section shoulder of said end plate and does not cover said connection area.

3. The timepiece sub-assembly, according to claim 1, wherein, in said second immobilised state, said adhesive layer covers said connection area.

4. The timepiece sub-assembly according to claim 1, wherein said adhesive layer forms a mechanical seal for said balance spring in said housing in all degrees of freedom.

5. The timepiece sub-assembly according to claim 1, wherein said end plate includes variable sections perpendicularly to said longitudinal direction.

6. The timepiece sub-assembly according to claim 5, wherein the section of said end plate decreases, continuously and/or in steps, from said distal end towards said outer coil.

7. The timepiece sub-assembly according to claim 6, wherein said end plate includes at least one said shoulder where the section of said end plate varies, said shoulder being distinct from said connection area, and in that, in said second immobilised state, said adhesive layer covers said shoulder, whereas said connection area remains outside said adhesive layer.

8. The timepiece sub-assembly according to claim 5, wherein said end plate includes at least a first shoulder and a second shoulder where the section of said end plate varies, said first shoulder and said second shoulder together delimiting a stop of maximum section of said end plate, said first shoulder and said second shoulder being distinct from said connection area.

9. The timepiece sub-assembly according to claim 8, wherein said first shoulder and said second shoulder are distinct from said distal end of said connection plate.

10. The timepiece sub-assembly according to claim 8, wherein said eye is housed inside said stop of maximum section of said end plate.

11. The timepiece sub-assembly according to claim 1, wherein said end plate forms a loop comprising at least one eye in which said layer, in said second immobilised state, only penetrates in an anchoring direction substantially perpendicular to said tangential direction.

12. The timepiece sub-assembly according to claim 1, wherein said end plate forms a hook comprising at least one eye open on the side of said outer coil, and including a bent portion at the end thereof farthest from said outer coil.

13. The timepiece sub-assembly according to claim 1, wherein said balance spring is made of silicon and/or silicon oxide.

14. An oscillator mechanism including at least one sub-assembly according to claim 1.

15. An escapement mechanism including at least one sub-assembly according to claim 1.

16. A watch comprising one said escapement mechanism according to claim 15.

* * * * *